US007270178B2

(12) United States Patent
Selph

(10) Patent No.: US 7,270,178 B2
(45) Date of Patent: Sep. 18, 2007

(54) HORIZONTALLY ORIENTED GAS SEPARATOR

(75) Inventor: Robert P Selph, Anzoátegui (VE)

(73) Assignee: Baker Hughes Incroporated, Houston, TX (US)

( * ) Notice: Subject to any disclaimer, the term of this patent is extended or adjusted under 35 U.S.C. 154(b) by 181 days.

(21) Appl. No.: 11/220,429

(22) Filed: Sep. 7, 2005

(65) Prior Publication Data

US 2007/0051509 A1 Mar. 8, 2007

(51) Int. Cl.
*E21B 43/38* (2006.01)

(52) U.S. Cl. ..... 166/105.5; 166/50; 417/423.3

(58) Field of Classification Search ..... 166/50, 166/105, 105.5, 54.1, 68; 417/295, 298, 417/423.3; 415/88, 901
See application file for complete search history.

(56) References Cited

U.S. PATENT DOCUMENTS 2,492,141 A * 12/1949 Gaylord ..... 310/87
3,410,217 A * 11/1968 Kork et al. ..... 417/58
5,588,486 A 12/1996 Heinrichs
5,653,286 A * 8/1997 McCoy et al. ..... 166/105.5
5,829,529 A * 11/1998 Cholet et al. ..... 166/369
6,179,054 B1 * 1/2001 Stewart ..... 166/105.5
6,715,556 B2 4/2004 Mack et al.

OTHER PUBLICATIONS

*Engineering Technical Brief*, Centrilift ESPCP, "Horizontal Gas Separator", Jul. 11, 2000, pp. 1-2.

* cited by examiner

*Primary Examiner*—Kenneth Thompson
(74) *Attorney, Agent, or Firm*—Bracewell & Giuliani LLP

(57) ABSTRACT

A gas restrictor for an intake of a horizontally oriented submersible well pump has a tubular housing and a number of apertures. A sleeve is mounted within the housing for rotation relative to the housing. The sleeve has an axially extending row of slots. At least one weight in the sleeve causes the sleeve to rotate to a position with the row of slots at the bottom of the sleeve while the well pump is oriented horizontally. The slots and apertures are arranged so that regardless of the particular orientation of the housing relative to the sleeve, at least one of the apertures will be in registry with one of the slots.

20 Claims, 3 Drawing Sheets

HORIZONTALLY ORIENTED GAS SEPARATOR

FIELD OF THE INVENTION

This invention relates in general to well pumps, and in particular to a restictor device that restricts entry of gas into the intake of a horizontally oriented well pump.

BACKGROUND OF THE INVENTION

Submersible well pumps are frequently employed for pumping well fluid from lower pressure oil wells. One type of pump comprises a centrifugal pump that is driven by a submersible electrical motor. The pump has a large number of stages, each stage comprising a diffuser and an impeller. Another type of pump, called progressive cavity pump, rotates a helical rotor within an elastomeric helical stator. In some installations, the motor for driving a progressive cavity pump is an electrical motor assembly attached to a lower end of the pump. Centrifugal pumps are normally used for pumping higher volumes of well fluid than progressive cavity pumps.

Both types of pumps become less efficient when significant amounts of gas from the well fluid flow into the intakes. In a horizontal well, any gas in the well fluid tends to migrate to the upper side of the casing, forming a pocket of free gas. The gas tends to flow into a portion of the intake on the higher side of the pump intake.

Gas restrictors or separators for coupling to the intake of pump in a horizontal well are known in the prior art. While the prior art types may be workable, improvements are desired, particularly for pumps that pump very viscous crude oil.

SUMMARY OF THE INVENTION

An intake apparatus for submersible well pump restricts the flow of gas when the well pump is oriented horizontally. The inlet device has a tubular housing that mounts to an intake of the pump. The housing has a sidewall with a plurality of apertures. A sleeve is mounted within the housing for rotation relative to the housing. The sleeve has an open downstream end that registers with an open downstream end of the housing. A row of slots is formed the sleeve. The slots are axially spaced apart from each other. At least one weight causes the sleeve to rotate to a position with the row of slots at the bottom of the sleeve when the pump is oriented horizontally.

The slots are preferably elongated and extend circumferentially along the sidewall of the sleeve less than 180 degrees. Preferably each slot has a width in an axial direction that is less than the circumferential length. Weights are preferably located in each space between the slots. The weights have a center of gravity that aligns with a centerline of the row of slots. The slots of the sleeve and apertures of the housing are positioned so that regardless of the orientation of the housing, at least one aperture will register with one of the slots.

DETAILED DESCRIPTION OF THE INVENTION

Figure 1:
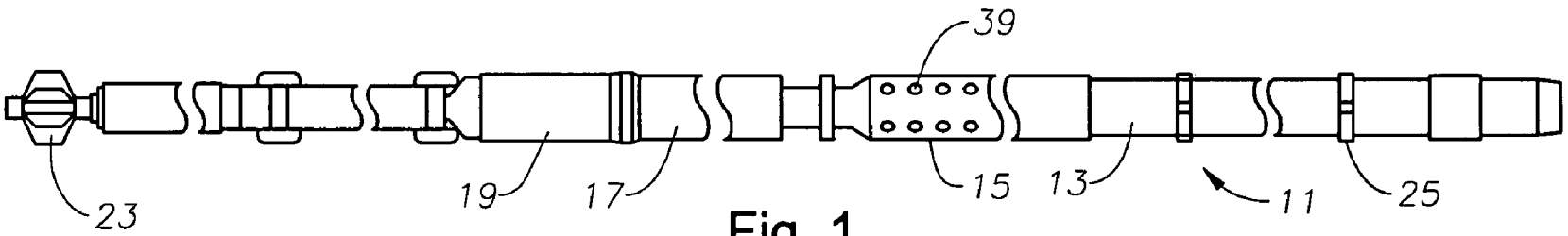
FIG. 1 is a schematic side elevational view of a well pump assembly constructed in accordance with this invention.

Referring to FIG. 1, pump assembly 11 is particularly configured for being used within a well having a horizontal section. Well pump assembly 11 has a pump 13 that in this embodiment comprises a progressing cavity pump, but it could be another type. Pump 13 has a rotor with a helical contour that is rotated within an elastomeric stator having a double helical passage. An intake section 15 secures to the upstream end of pump 13 for delivering well fluid to pump 13. A seal section 17 is located at the upstream end of intake section 15. A gear box 19 secures between seal section 17 and an electrical motor 21. Motor 21 drives a shaft assembly that extends from gear box 19 through seal section 17 and intake section 15 to the rotor of pump 13. Centralizers 23, 25 are located at opposite ends of pump assembly 11. Additional centralizers may be located between centralizers 23, 25, as shown.

Figure 2:
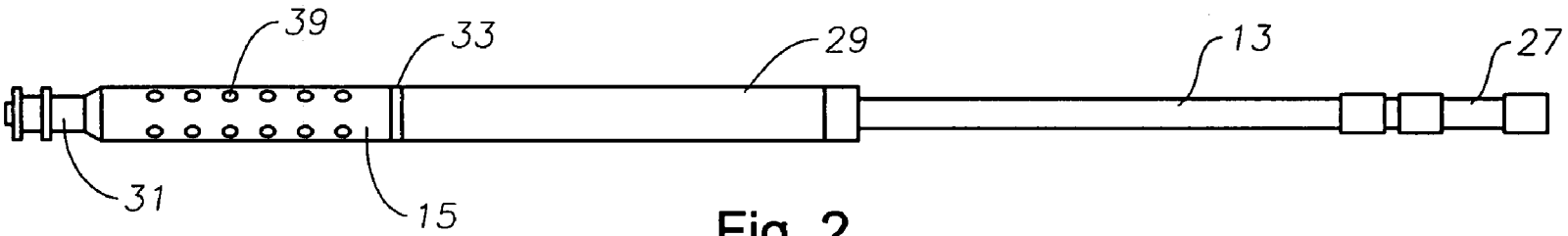
FIG. 2 is a more detailed view of the pump portion of the well pump assembly of FIG. 1.

Referring to FIG. 2, the housing of pump 13 is shown connected to production tubing 27 that extends up the well to a wellhead (not shown) at the surface. FIG. 2 also shows a flex shaft assembly 29 that locates between intake section 15 and pump 13. The motor shaft (not shown) at the upstream end of flex shaft assembly 29 rotates concentrically while the rotor in pump 13 rotates eccentrically. Flex shaft assembly 29 contains a shaft portion that flexes to accommodate the difference in rotational movement. In this embodiment, intake section 15 is connected to flex shaft assembly 29 by a coupling 33, but the units could be integral with each other.

Figure 3A:
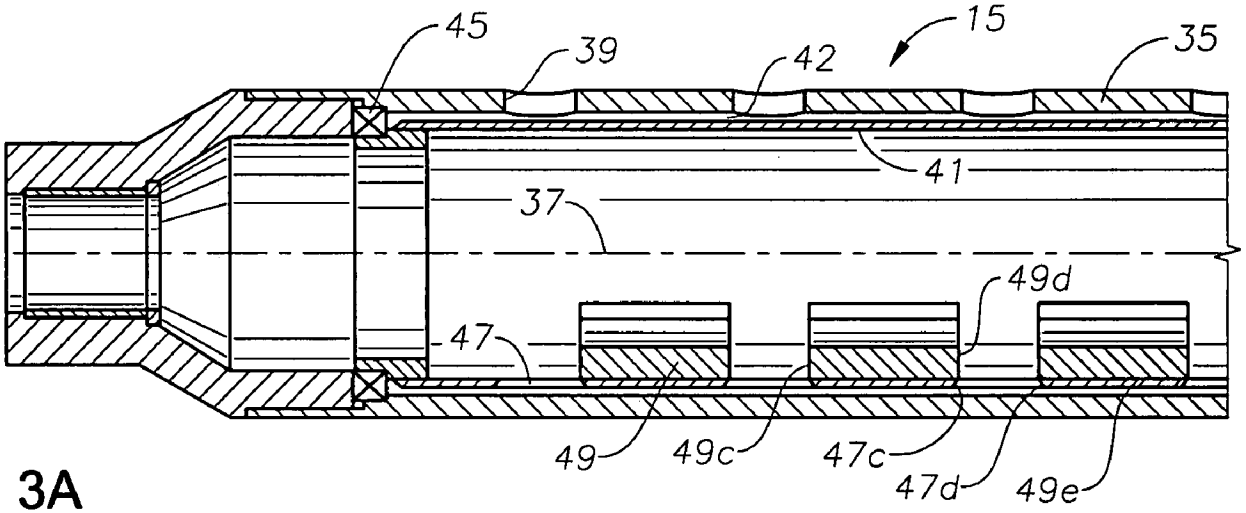
FIGS. 3A and 3B comprise a vertical sectional view of the intake assembly for the pump of FIG. 1.
Figure 3B:
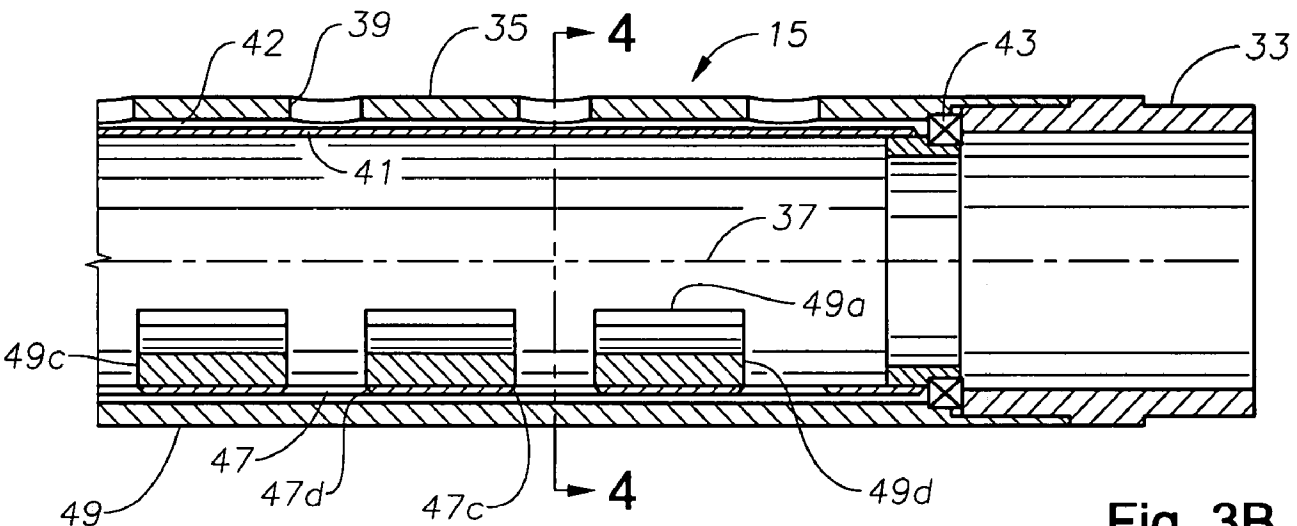
Figure 4:
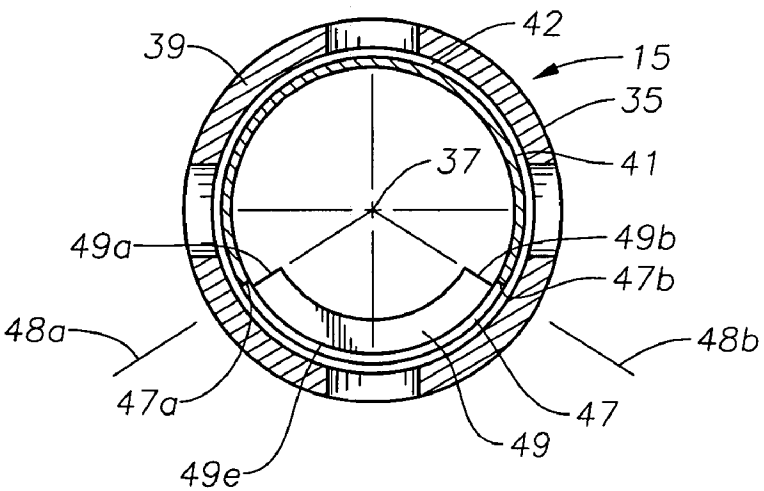
FIG. 4 is a sectional view of the intake assembly of FIGS. 3A and 3B, taken along the line 4-4 of FIG. 3B.

Referring to FIG. 3A, intake section 15 includes a tubular housing 35 that is cylindrical and has a longitudinal axis 37. Housing 35 has a plurality of holes or apertures 39 spaced around its circumference. In this embodiment, apertures 39 are circular, however they could be of other shapes. Being circular, the diameter measured parallel to axis 37 is the same as the diameter measured perpendicular to axis 37. In the preferred embodiment, apertures 39 are in circumferential rows spaced equally apart from each other along the length of housing 35. As shown in FIGS. 3A and 3B, in this embodiment, there are seven circumferential rows of apertures 39, but that number can differ. As shown in FIG. 4, in this embodiment, there are four apertures 39 within each circumferential row, but that number could also differ. With four apertures 39, the centerline of each aperture 39 within a circumferential row is spaced 90 degrees apart from its adjacent apertures 39 in the same row. The centerlines of the four apertures 39 within each circumferential row are located in a common plane that is perpendicular to axis 37. Also, each aperture 39 in one circumferential row is axially aligned with one aperture 39 in each of the other circumferential rows.

A sleeve 41 is mounted concentrically within housing 35 for rotation relative to housing 35. Sleeve 41 is cylindrical and has an outer diameter that is less than an inner diameter of housing 35, creating an annular clearance or space 42 between sleeve 41 and housing 35. Sleeve 41 is supported at each end by bearings 43, 45, which may be of any suitable type that will enable sleeve 41 to freely rotate about axis 37.

Figure 6:
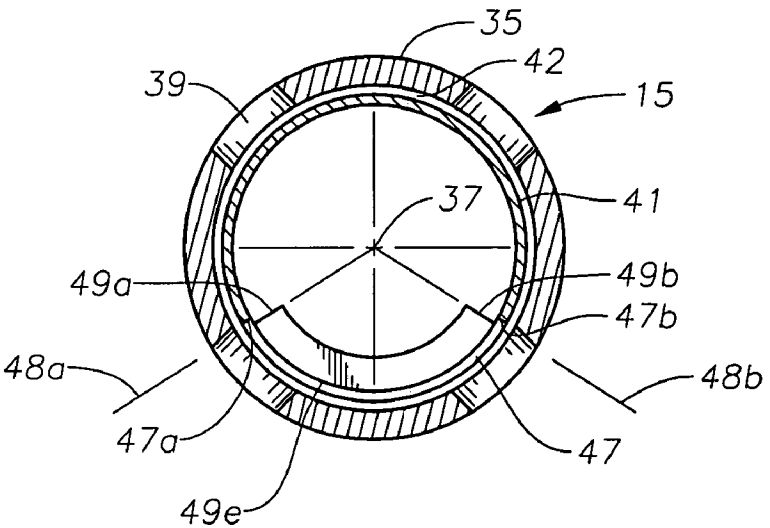
FIG. 6 is a sectional view of the intake assembly similar to FIG. 4, but showing two housing apertures aligned with one slot in the inner sleeve.

Sleeve 41 has a plurality of slots 47 formed in its sidewall and aligned in an axial row. A single line (not shown) passing through the center point of all of the slots 47 is parallel to axis 37. Each slot 47 is elongated, as shown in FIG. 6, having two ends 47*a* and 47*b* that are spaced apart circumferentially from each other. In this embodiment, ends 47*a* and 47*b* are approximately 115 degrees apart, as indicated by radial lines 48*a* and 48*b*.

Preferably, the circumferential distance from end 47*a* to end 47*b* is substantially equal to the circumferential distance from the farthest edges of two adjacent apertures 39. When housing 35 aligns perfectly with sleeve 41, as shown in FIG. 6, the two apertures 39 on the lower side fully register with one of the slots 47. Radial line 48*a* is tangent to slot end 47*a* and to an outside edge of one of the apertures 39 when perfectly aligned. Radial line 48*b* is tangent to slot end 47*b* and to an outside edge of an adjacent aperture 39. The dimensions and positions of apertures 39 and slots 47 assure that even if housing 35 is misaligned relative to sleeve 41, such as shown in FIG. 4, at least one of the apertures 39 will be in full registry with one of the slots 47. Any fluid flowing through an aperture 39 that is fully registered with one of the slots 47 will be able to flow unimpeded into sleeve 41. There would be no reduction in flow area from a fully registered aperture 39 to slot 47.

Figure 5:
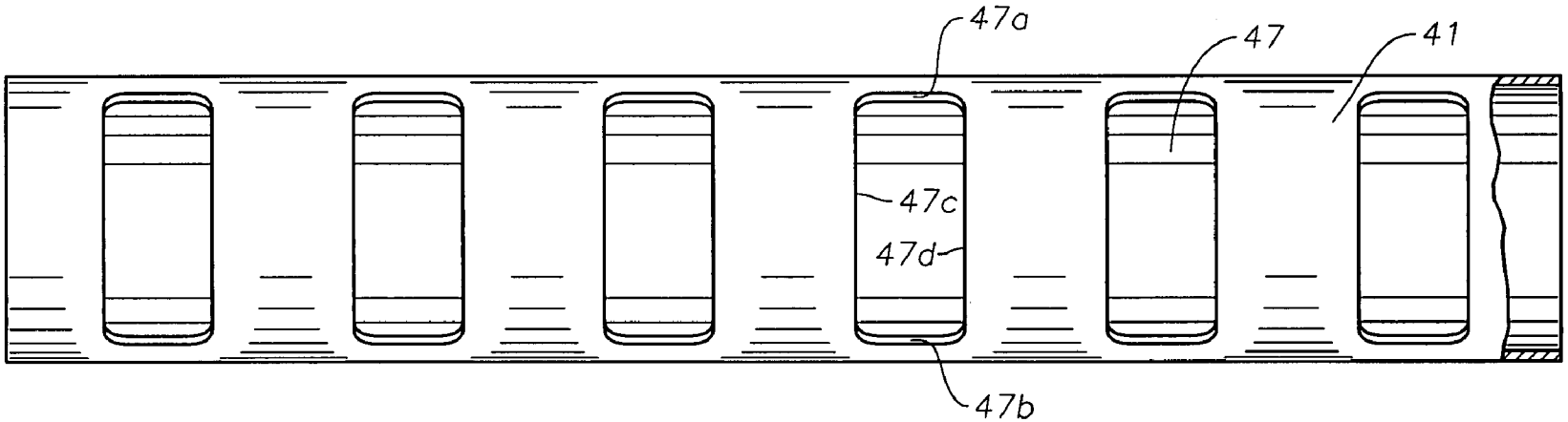
FIG. 5 is a bottom plan view of the inner sleeve of the intake assembly of FIGS. 3A and 3B, shown removed from the intake housing.

Referring again to FIG. 5, in this example, slots 47 have upstream and downstream side edges 47*c* and 47*d* that are preferably parallel with each other and perpendicular to axis 37. In the embodiment shown, the diameter of each aperture 39 is substantially the same as the axial distance between slot side edges 47*c* and 47*d*, although the dimensions could differ. Also, in the embodiment shown, the distance from side edge 47*c* of one slot 47 to side edge 47*d* of the adjacent slot 47 is greater than the axial width between side edges 47*c* and 47*d* of one slot 47. The axial distance from a center point equidistant between side edges 47*c* and 47*d* to a center point of an adjacent slot 47 is the same as the axial distance between centerlines of apertures 39 of adjacent circumferential rows in this embodiment. The apertures 39 in each circumferential row align axially with one of the slots 47.

At least one weight 49 is mounted to sleeve 41 to rotate sleeve 41 by gravity to a position with slots 47 on the bottom. Preferably, a plurality of weights 49 are mounted to sleeve 41 within its interior as illustrated in FIGS. 3A, 3B, 4 and 6. Weights 49 could have a variety of shapes and sizes. In this example, each weight 49 is positioned between two adjacent slots 47 and has two circumferentially spaced apart ends 49*a* and 49*b* as shown in FIGS. 4 and 6. Ends 49*a* and 49*b* are approximately the same circumferential distance apart as the circumferential distance between slot ends 47*a* and 47*b*. Each weight 49 in this example has side edges 49*c* and 49*d* that are substantially flush with slot side edges 47*c* and 47*d*. Each weight 49 has an outer arcuate or circumferentially extending surface 49*e* formed at the same diameter as the inner diameter of sleeve 41. Outer surface 49*e* mates with the interior surface of sleeve 41 and is preferably attached by an adhesive. A center gravity of each weight 49 is halfway between its circumferential ends 49*a*, 49*b*. A single line (not shown) extending through the centers of gravity of all of the weights 49 will be parallel to axis 37.

In operation, well pump assembly 11 is assembled as shown in FIG. 1 and lowered on tubing 27 (FIG. 2) into a casing within a well. Typically, when positioned at the proper depth in a well having a horizontal section, pump assembly 11 will be oriented horizontally as shown. Apertures 39 may be at any particular position such as shown by the difference between FIGS. 4 and 6. Weights 49, however, will cause sleeve 41 to rotate about bearings 43, 45 to the position shown in FIGS. 4 and 6. If housing 35 is in the position of FIG. 6, two of the apertures 39 will be fully in registry with each of the slots 47. If housing 35 is oriented as shown in FIG. 6, one of the apertures 39 will be in full registry with each of the slots 47. Regardless of the orientation of housing 35, at least one aperture 39 will be in full registry with each of the slots 47.

The well fluid will naturally separate into primarily liquid in the lower portion of the casing and gas in the upper portion. The liquid will flow radially through at least one lower aperture 39 in each circumferential row of apertures 39, straight through each of the slots 47 and into the interior of sleeve 41. The liquid flows along the interior of sleeve 41 and through coupling 33 (FIG. 3A and FIG. 2) into flex shaft assembly 29, and from there into pump 13. Pump 13, which is driven by motor 21, pumps the liquid to the surface.

Gas, on the other hand, may migrate into the upper apertures 39, but normally not to the lower apertures 39 because the lower apertures 39 will typically be located below the liquid level. The gas will not flow downward around annular space 42 and into slots 47 because the gas is lighter than the liquid. Gas that enters annular space 42 will flow out the upper apertures 39.

Figure 7:
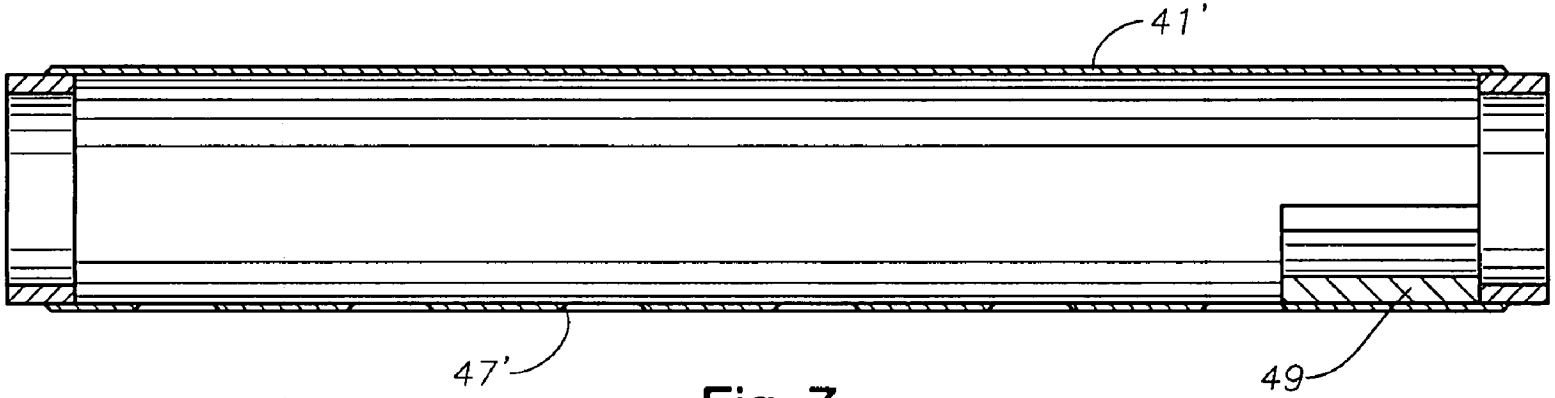
FIG. 7 is a section view of an alternate embodiment of an inner sleeve of the intake assembly of FIGS. 3A and 3B, shown removed from the intake housing.

In the alternate embodiment of FIG. 7, sleeve 41' has a row of slots 47' that are spaced axially apart from each other. However, there is only one weight 49', and it is located at the proximal or downstream end of sleeve 41'. In this embodiment, weight 49' is downstream of all of the slots 47'. There are no weights located between slots 47' as in the first embodiment. Weight 49' may be of a larger size than weights 49 of FIGS. 3A and 3B so as to provide adequate counterweight to cause sleeve 41' to orient with slots 47' on the bottom. Other than the difference in weights 49' and 49, sleeve 41' is constructed the same as in the first embodiment The invention has significant advantages. A large portion of any gas contained within the casing of a horizontal well will be blocked from entry into the pump thus improving the efficiency of the pump. The alignment of the outer housing apertures with the elongated slots in the sleeve assures that the liquid will always have at least one clear radial path to pass into the interior of the sleeve. The liquid does not have to flow along a tortuous path in the annular space between the sleeve and the housing. There is no decrease in flow area from an aperture to a slot if the aperture fully registers with the slot. A straight flow path without a decrease in flow area facilitates the flow of heavy, viscous crude oil.

While the invention has been shown in only one of its forms, it should be apparent to those skilled in the art that it is not so limited but is susceptible to various changes without departing from the scope of the invention.

I claim:

1. An inlet apparatus for a submersible well pump, comprising:

a tubular housing for connection to an intake of the pump, the housing having an axis and a sidewall containing a plurality of apertures;

a sleeve mounted within the housing for rotation relative to the housing;

an axially extending row of slots in the sleeve; and at least one weight in the sleeve for causing the sleeve to rotate to and maintain a position with the row of slots in a bottom position when the well pump is oriented horizontally.

2. The apparatus according to claim 1, wherein the slots are elongated in a direction perpendicular to the axis.

3. The apparatus according to claim 1, wherein each of the slots extends circumferentially a greater distance than an axial width of each of the slots.

4. The apparatus according to claim 1, wherein said at least one weight comprises a plurality of weights, each of the weights being located between two of the slots.

5. The apparatus according to claim 1, wherein said at least one weight comprises a plurality of weights, each of the weights having a curved portion that mates with and attaches to part of an interior circumferential surface of the sleeve, and each of the weights having two ends circumferentially spaced apart from one another.

6. The apparatus according to claim 1, wherein said at least one weight comprises a plurality of weights, each of the weights having a curved outer portion that mates with and attaches to part of an interior circumferential surface of the sleeve, each of the weights having two ends located a circumferential distance apart from one another, the circumferential distance being greater than an axial width of each of the weights.

7. The apparatus according to claim 1, wherein at least one of the apertures registers with each of the slots regardless of the rotational orientation of the housing relative to the sleeve.

8. The apparatus according to claim 1, wherein said at least one weight is located at a proximal end of the sleeve, and the distal end of the sleeve is free of any of the weights.

9. An inlet apparatus for restricting gas entry to a submersible well pump while oriented horizontally, comprising:

a cylindrical housing for connection to an intake of the pump, the housing having an axis and a plurality of apertures spaced circumferentially around the housing and along an axial length of the housing;

a sleeve having upstream and downstream ends supported concentrically within the housing by bearings for rotation relative to the housing, the sleeve having a circumferential sidewall dimensioned to define an annular clearance between the sleeve and the housing;

a plurality of slots in the sidewall of the sleeve, each of the slots extending circumferentially a selected distance and being axially spaced apart from adjacent ones of the slots, each of the slots having a center point, and the slots being positioned so that a single line passing through the center points of all of the slots is parallel to the axis of the housing; and at least one weight attached to an interior surface portion of the sidewall of the sleeve, the weight having a center of gravity that causes the sleeve to rotate to a position with the slots on a bottom of the sleeve when the well pump is oriented horizontally.

10. The apparatus according to claim 9, wherein each of the slots extends circumferentially a greater distance than an axial width of each of the slots.

11. The apparatus according to claim 9, wherein the weight has a circumferential length greater than its axial width.

12. The apparatus according to claim 9, wherein said at least one weight comprises a plurality of weights, each of the weights is located between two of the slots.

13. The apparatus according to claim 9, wherein:

a circumferential distance between adjacent ones of the apertures is less than a circumferential distance between circumferential ends of each of the slots; and each of the apertures is located the same axial position as one of the slots, so that regardless of the orientation of the housing relative to the sleeve, one of the apertures will register with one of the slots.

14. The apparatus according to claim 9, wherein said at least one weight comprises a single weight located at a proximal end of the sleeve.

15. The apparatus according to claim 9, wherein the weight has an outer surface that is formed at a diameter substantially the same as an inner diameter of the sidewall of the sleeve, but extends less than 180 degrees.

16. An apparatus for pumping a well, comprising:

a pump;

the pump having an intake section that includes a tubular housing, the housing having an axis and a plurality of apertures spaced circumferentially around the housing and along the axial length of the housing;

a sleeve having upstream and downstream ends supported by bearings within the housing for rotation relative to the housing;

the sleeve having a sidewall that is impermeable except for a single axially extending row of slots formed therein, each of the slots having a circumferential length extending partially around a circumference of the sleeve;

at least one weight attached to the sleeve to orient the row of slots on a bottom of the sleeve;

wherein a circumferential distance between adjacent ones of the apertures is less than a circumferential extent of each of the slots; and wherein each of the apertures is located the same axial position as one of the slots, so that regardless of the orientation of the housing relative to the sleeve, one of the apertures will register with one of the slots when the pump is horizontal.

17. The apparatus according to claim 16, wherein the weight has an outer surface that is formed at a diameter substantially equal to an inner diameter of the sleeve, the outer surface of the weight being in mating contact with an interior portion of the sleeve.

18. The apparatus according to claim 16, wherein each of the apertures has an axial dimension substantially no greater than an axial width of each of the slots, and a circumferential dimension less than the circumferential extent of each of the slots.

19. The apparatus according to claim 16, wherein said at least one weight is located downstream of all of the slots.

20. The apparatus according to claim 16, wherein said at least one weight comprises a plurality of weights, each of the weights is located between adjacent ones of the slots.

* * * * *